US005830844A

United States Patent [19]

Detering et al.

[11] Patent Number: 5,830,844

[45] Date of Patent: Nov. 3, 1998

[54] DYE TRANSFER INHIBITORS FOR DETERGENTS

[75] Inventors: Jürgen Detering, Limburgerhof; Christian Schade, Ludwigshafen; Johannes Perner; Hans-Ulrich Jäger, both of Neustadt, all of Germany

[73] Assignee: BASF Aktiengesellschaft, Ludwigshafen, Germany

[21] Appl. No.: 750,478

[22] PCT Filed: Jun. 3, 1995

[86] PCT No.: PCT/EP95/02111

§ 371 Date: Dec. 17, 1996

§ 102(e) Date: Dec. 17, 1996

[87] PCT Pub. No.: WO95/35360

PCT Pub. Date: Dec. 28, 1995

[30] Foreign Application Priority Data

Jun. 17, 1994 [DE] Germany ..... 44 21 179.1

[51] Int. Cl.[6] ..... C11D 3/37

[52] U.S. Cl. ..... 510/475

[58] Field of Search ..... 510/475, 500, 510/503, 513; 8/553

[56] References Cited

U.S. PATENT DOCUMENTS 5,098,598 3/1992 Sankey et al. ..... 252/186.42

5,266,587 11/1993 Sankey et al. ..... 514/417

OTHER PUBLICATIONS

Product Information, International Specialty Products, Bound Brook, NJ, Dec. 1997.

*Primary Examiner*—Paul Lieberman
*Assistant Examiner*—John R. Hardee
*Attorney, Agent, or Firm*—Oblon, Spivak, McClelland, Maier & Neustadt, P.C.

[57] ABSTRACT

Water-insoluble, crosslinked polymers containing polymerized units of 1-vinylpyrrolidone and/or 1-vinylimidazoles of the formula

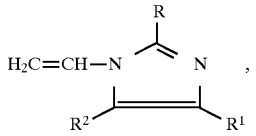

(I)

where R, $R^1$ and $R^2$ are identical or different and each is hydrogen, $C_1$–$C_4$-alkyl or phenyl, or of 4-vinylpyridine N-oxide, in finely divided form, at least 90% by weight of the polymers having a particle size from 0.1 to 500 $\mu$m, are useful as detergent additives for inhibiting the transfer of dye during the wash.

8 Claims, No Drawings

DYE TRANSFER INHIBITORS FOR DETERGENTS

BACKGROUND OF THE INVENTION

1. Field of the Invention

The present invention relates to the use of water-insoluble, crosslinked polymers as detergent additives for inhibiting the transfer of dye during the wash and to detergents containing these polymers.

2. Discussion of the Background

The use of water-soluble homo- and copolymers of 1-vinylpyrrolidone and 1-vinylimidazole as dye transfer inhibitor for detergents is known; cf. DE-B-22 32 353 and DE-A-28 14 287. The known polymers have the disadvantage that they are neither biodegradable nor completely removable from the effluent by adsorption on sewage sludge. DE-A-28 14 287, in addition to water-soluble polymers, also describes water-insoluble polymers based on 1-vinylimidazole for use as dye transfer inhibitors. As is stated in this reference, the incorporation of crosslinkers in the polymers leads to three-dimensionally crosslinked polymers of high viscosity and decreasing water solubility. The proportion of cross-linker in the copolymer should therefore preferably be less than 5 mol %. According to this reference, the polymers should be soluble or, through the incorporation of hydrophobic monomer units, dispersible in water, so that the use of water-insoluble cross-linked polymers is not recommended. This is confirmed by the illustrative embodiments.

WO-A-94/2578 discloses using poly(4-vinylpyridine N-oxide) as dye transfer inhibitor in detergents. Here, too, the polymer in question is water-soluble.

SUMMARY OF THE INVENTION

It is an object of the present invention to provide dye transfer inhibitors for detergents which, compared with the known inhibitors, are highly eliminable from the effluent.

We have found that this object is achieved by the use of water-insoluble, crosslinked polymers containing polymerized units of 1-vinylpyrrolidone and/or 1-vinylimidazoles of the formula

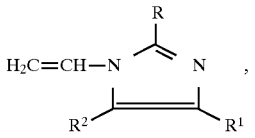

(I)

where R, $R^1$ and $R^2$ are identical or different and each is hydrogen, $C_1$–$C_4$-alkyl or phenyl, or of 4-vinylpyridine N-oxide, in finely divided form, at least 90% by weight of the polymers having a particle size from 0.1 to 500 $\mu$m, as detergent additive for inhibiting the transfer of dye during the wash.

The present invention also provides detergents based on surfactants and optionally builders and other customary ingredients, comprising from 0.1 to 10% by weight, based on the detergent formulation, of water-insoluble crosslinked polymers containing polymerized units of 1-vinylpyrrolidone and/or 1-vinylimidazoles of the formula

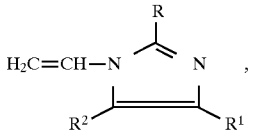

(I)

where R, $R^1$ and $R^2$ are identical or different and each is hydrogen, $C_1$–$C_4$-alkyl or phenyl, or of 4-vinylpyridine N-oxide, in finely divided form, at least 90% by weight of the polymers having a particle size from 0.1 to 500 $\mu$m.

DETAILED DESCRIPTION OF THE PREFERRED EMBODIMENTS

Water-insoluble crosslinked polymers have hitherto not been used as dye transfer inhibitors for reasons connected with the sorption kinetics. It has now been found, surprisingly, that water-insoluble crosslinked polymers which have a particle size from 0.1 to 500 $\mu$m are excellent dye transfer inhibitors which in some instances even exceed the effectiveness of the water-soluble polymers.

Suitable water-insoluble, crosslinked polymers are obtainable for example by using as monomers of group (a) 1-vinylpyrrolidone and/or 1-vinylimidazoles of the formula

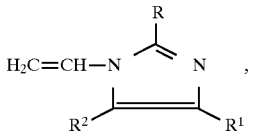

(I)

where R, $R^1$ and $R^2$ are identical or different and each is H, $C_1$–$C_4$-alkyl or phenyl. The preferred meanings for R, $R^1$ and $R^2$ are H, $CH_3$ and $C_2H_5$.

Monomers of group (a) include for example 1-vinylimidazole, 2-methyl-1-vinylimidazole, 2-ethyl-1-vinylimidazole, 2-propyl-1-vinylimidazole, 2-butyl-1-vinylimidazole, 2,4-dimethyl-1-vinylimidazole, 2,5-dimethyl-1-vinylimidazole, 2-ethyl-4-methyl-1-vinylimidazole, 2-ethyl-5-methyl-1-vinylimidazole, 2,4,5-trimethyl-1-vinylimidazole, 4,5-diethyl-2-methyl-1-vinylimidazole, 4-methyl-1-vinylimidazole, 5-methyl-1-vinylimidazole, 4-ethyl-1-vinylimidazole, 4,5-dimethyl-1-vinylimidazole and 2,4,5-triethyl-1-vinylimidazole. It is also possible to use mixtures of said monomers in any desired proportion. Preference is given to using 2-methyl-1-vinylimidazole, 2-ethyl-1-vinylimidazole, 2-ethyl-4-methyl-1-vinylimidazole, 4-methyl-1-vinylimidazole or mixtures of 1-vinylpyrrolidone and 1-vinylimidazole or mixtures of 1-vinylpyrrolidone and 2-methyl-1-vinylimidazole. Very particular preference is given to 1-vinylimidazole, 1-vinylpyrrolidone and 2-methyl-1-vinylimidazole. The monomer of group (a) preferably comprises from 40 to 100% by weight of the polymer.

To prepare the crosslinked, water-insoluble polymers, the monomers of group (a) may be copolymerized with monomers of group (b). These are monoethylenically unsaturated monomers other than the monomers of group (a), for example acrylamides, vinyl esters, vinyl ethers, (meth) acrylic esters, (meth)acrylic acid, maleic acid, maleic esters, styrene, 1-alkenes, 1-vinylcaprolactam, 1-vinyloxazolidinone, 1-vinyltriazole, N-vinylformamide, N-vinylacetamide and/or N-vinyl-N-methylacetamide.

Monomer (b) preferably comprises (meth)acrylic esters derived from aminoalcohols. These monomers contain a basic nitrogen atom. They are used either in the form of the free bases or in neutralized or quaternized form. Further preferred monomers are monomers containing a basic nitrogen atom and an amide group in the molecule. Examples of these preferred monomers include N,N'-dialkylaminoalkyl (meth)acrylates, e.g. dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate and diethylaminopropyl methacrylate. Basic polymers which additionally contain an amide group in the molecule include N,N'-dialkylaminoalkyl(meth) acrylamides, for example N,N'-di-$C_1$–$C_3$-alkylamino-$C_2$–$C_6$-alkyl(meth)acrylamides, eg. dimethylaminoethylacrylamide, dimethylaminoethylmethacrylamide, diethylaminoethylacrylamide, diethylaminoethylmethacrylamide, dimethylaminopropylacrylamide and dimethylaminopropylmethacrylamide.

Further monomers with a basic nitrogen atom are 4-vinylpyridine, 2-vinylpyridine, diallyldi($C_1$–$C_{12}$-alkyl) ammonium compounds and diallyl-$C_1$–$C_{12}$-alkylamines. The basic monomers are used in the copolymerization in the form of the free bases, in the form of their salts with organic or inorganic acids or in quaternized form. Suitable quaternizing agents include for example alkyl halides having from 1 to 18 carbon atoms in the alkyl group, for example methyl chloride, ethyl chloride or benzyl chloride. The nitrogen-containing basic monomers can also be quaternized by reaction with dialkyl sulfates, in particular with diethyl sulfate or dimethyl sulfate. Examples of quaternized monomers include methacryloyloxyethyltrimethylammonium chloride, methacryloyloxyethyldimethylammonium ethylsulfate and methacrylamidoethyldimethylethylammonium ethylsulfate. It is also possible to use 1-vinylimidazolium compounds which have been for example quaternized with $C_1$–$C_{18}$-alkyl halides, dialkyl sulfates or benzyl chloride or converted with an acid into the salt form. Such monomers can be characterized for example by means of the general formula

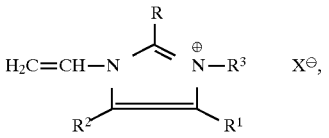

(II)

where $R, R^1, R^2$=H, $C_1$–$C_4$-alkyl or phenyl, $R^3$=H, $C_1$–$C_{18}$-alkyl or benzyl, and $X^{\ominus}$=anion.

In the formula II, the anion can be a halide ion, an alkylsulfate anion or else the radical of an inorganic or organic acid. Examples of quaternized 1-vinylimidazoles of the formula II are 3-methyl-1-vinylimidazolium chloride, 3-benzyl-1-vinylimidazolium chloride or 3-ethyl-1-vinylimidazolium ethylsulfate. It is of course also possible for the polymers which contain monomers (a) and optionally 1-vinylimidazole or basic monomers (c) to be quaternized to some extent by reaction with customary quaternizing agents such as dimethyl sulfate or methyl chloride. If monomers (b) are used, they are present in the monomer mixture in an amount of up to 30% by weight.

The direct preparation of water-insoluble crosslinked polymers is effected by polymerizing the monomers (a) and optionally (b) in the presence of monomers of group (c). These are monomers which contain at least 2 monoethylenically unsaturated double bonds in the molecule. Compounds of this type are customarily used as crosslinkers in polymerization reactions.

Suitable crosslinkers of this kind include for example acrylic esters, methacrylic esters, allyl ethers or vinyl ethers of at least dihydric alcohols. The OH groups of the parent alcohols can be wholly or partly etherified or esterified; but the crosslinkers contain at least two ethylenically unsaturated groups. Examples of the parent alcohols include dihydric alcohols such as 1,2-ethanediol, 1,2-propanediol, 1,3-propanediol, 1,2-butanediol, 1,3-butanediol, 2,3-butanediol, 1,4-butanediol, but-2-ene-1,4-diol, 1,2-pentanediol, 1,5-pentanediol, 1,2-hexanediol, 1,6-hexanediol, 1,10-decanediol, 1,2-dodecanediol, 1,12-dodecanediol, neopentylglycol, 3-methylpentane-1,5-diol, 2,5-dimethyl-1,3-hexanediol, 2,2,4-trimethyl-1,3-pentanediol, 1,2-cyclohexanediol, 1,4-cyclohexanediol, 1,4-bis(hydroxymethyl)cyclohexane, neopentyl hydroxypivalate, 2,2-bis(4-hydroxyphenyl)propane, 2,2-bis[4-(2-hydroxypropyl)phenyl]propane, diethylene glycol, triethylene glycol, tetraethylene glycol, dipropylene glycol, tripropylene glycol, tetrapropylene glycol, 3-thiopentane-1,5-diol, and also polyethylene glycols, polypropylene glycols and polytetrahydrofurans having molecular weights in each case from 200 to 10 000. As well as the homopolymers of ethylene oxide or propylene oxide, it is also possible to use block copolymers of ethylene oxide or propylene oxide or copolymers which contain incorporated ethylene oxide and propylene oxide groups. Examples of parent alcohols having more than two OH groups are trimethylolpropane, glycerol, pentaerythritol, 1,2,5-pentanetriol, 1,2,6-hexanetriol, triethoxycyanuric acid, sorbitan, sugars such as sucrose, glucose, mannose. Of course, the polyhydric alcohols can also be used after reaction with ethylene oxide or propylene oxide, in the form of the corresponding ethoxylates or propoxylates.

Further suitable crosslinkers include the vinyl esters or the esters of monohydric, unsaturated alcohols with ethylenically unsaturated $C_3$–$C_6$-carboxylic acids, for example acrylic acid, methacrylic acid, itaconic acid, maleic acid or fumaric acid. Examples of such alcohols are allyl alcohol, 1-buten-3-ol, 5-hexen-1-ol, 1-octen-3-ol, 9-decen-1-ol, dicyclopentenyl alcohol, 10-undecen-1-ol, cinnamyl alcohol, citronellol, crotyl alcohol or cis-9-octadecen-1-ol. However, it is also possible to esterify the monohydric unsaturated alcohols with polybasic carboxylic acids, for example malonic acid, tartaric acid, trimellitic acid, phthalic acid, terephthalic acid, citric acid or succinic acid.

Further suitable crosslinkers are esters of unsaturated carboxylic acids with the above-described polyhydric alcohols, for example of oleic acid, crotonic acid, cinnamic acid or 10-undecenoic acid.

Also suitable are straight-chain or branched, linear or cyclic, aliphatic or aromatic hydrocarbons with at least two double bonds which, in the case of aliphatic hydrocarbons, must not be conjugated, e.g. divinylbenzene, divinyltoluene, 1,7-octadiene, 1,9-decadiene, 4-vinyl-1-cyclohexene, trivinylcyclohexane or polybutadienes having molecular weights of 200–20 000. Suitable crosslinkers also include the acrylamides, methacrylamides and N-allylamines of at least difunctional amines. Such amines include for example 1,2-diaminomethane, 1,2-diaminoethane, 1,3-diaminopropane, 1,4-diaminobutane, 1,6-diaminohexane, 1,12-dodecanediamine, piperazine, diethylenetriamine and isophoronediamine. Also suitable are the amides of allylamine and unsaturated carboxylic acids such as acrylic acid, methacrylic acid, itaconic acid, maleic acid or at least dibasic carboxylic acids such as those described above.

Also suitable are N-vinyl compounds of urea derivatives, at least difunctional amides, cyanurates or urethanes, for example of urea, ethyleneurea, propyleneurea or tartramide.

Further suitable crosslinkers include divinyldioxane, tetraallylsilane and tetravinylsilane. It is of course also possible to use mixtures of the aforementioned compounds. Preference for use as crosslinker for the insoluble polymers is given to N,N'-divinylethyleneurea.

In the direct preparation of water-insoluble crosslinked polymers, the monomers of group (c) are used in amounts of up to 40, preferably from 0.1 to 10, % by weight, based on the monomer mixtures. Preferred contemplated polymers comprise N,N-divinylethyleneurea-crosslinked polymers of 1-vinylpyrrolidone, 1-vinylimidazole and/or 2-methyl-1-vinylimidazole.

The monomers are usually polymerized, generally in an inert gas atmosphere, using initiators which generate free radicals. The free-radical initiators used can be hydrogen peroxide or inorganic persulfates, but also organic compounds of the peroxide, peroxy ester, percarbonate or azo type, e.g. dibenzoyl peroxide, di-t-butyl peroxide, t-butyl hydroperoxide, dilauroyl peroxide, t-butyl perpivalate, t-amyl perpivalate, t-butyl perneodecanoate, 2,2'-azobis(2-amidinopropane) dihydrochloride, 4,4'-azobis(4-cyanovaleric acid), 2,2'-azobis[2-(2-imidazolin-2-yl) propane]dihydrochloride, 2,2'-azobis(2,4-dimethylvaleronitrile), 2,2'-azobisisobutyronitrile, 2,2'-azobis(2-methylbutyronitrile) and dimethyl 2,2'-azobis (isobutyrate). It is of course also possible to use initiator mixtures or the known redox initiators.

The water-insoluble crosslinked polymers can be prepared by any known method of polymerization.

Suitable methods of polymerization include, as well as the methods of bulk and gel polymerization, the methods of emulsion and inverse emulsion polymerization. Of particular suitability, however, are the methods of suspension polymerization, inverse suspension polymerization, precipitation polymerization and popcorn polymerization, which are all notable for their convenience and make it possible to control the polymerization process in such a way that the polymer is obtained directly in a finely divided form.

In suspension polymerization, the monomers are dispersed as droplets by stirring in an aqueous salt solution, for example an aqueous sodium sulfate solution, and polymerized by addition of free-radical initiator. To stabilize the dispersed monomer droplets and later the suspended polymer particles, it is possible to use protective colloids, inorganic suspension aids or emulsifiers. The properties of the polymers can be significantly influenced by addition of pore formers such as ethyl acetate, cyclohexane, n-pentane, n-hexane, n-octane, n-butanol, isodecanol, methyl ethyl ketone or isopropyl acetate. The particle size can be influenced for example by the choice and concentration of dispersant and also by the choice of stirrer and stirrer speed. The suspension polymer is isolated by filtration or centrifugation, thoroughly washed, dried and, if necessary, ground to particles having a size less than 500 $\mu$m. The grinding can also take place in the wet state. If the polymers are obtained in the form of fine beads, the polymerization is referred to as a bead polymerization.

In the method of inverse suspension polymerization, the monomers are dissolved in water and this phase is suspended in an inert organic solvent, for example cyclohexane, and polymerized. The system advantageously has protective colloids or emulsifiers added to it. After the reaction has ended, the water can be removed, for example by azeotropic distillation, and the product isolated by filtration.

The method of precipitation polymerization involves the use of solvents or solvent mixtures in which the monomers to be polymerized are soluble, but not the polymer which is formed. The insoluble or only limitedly soluble polymer precipitates from the reaction mixture during the polymerization. The polymerization products are dispersions (suspensions) which can if necessary be stabilized by addition of dispersants. Suitable solvents include for example n-hexane, cyclohexane, n-heptane, diethyl ether, t-butyl methyl ether, acetone, methyl ethyl ketone, diethyl ketone, ethyl acetate, methyl acetate, 1-hexanol and 1-octanol. The precipitation polymers are worked up by filtration, washing, drying and, if necessary, grinding or classification.

In bulk polymerization, the monomers are polymerized in the absence of solvents or diluents.

A specific method for preparing crosslinked polymers is that known as popcorn or proliferous polymerization (Encyclopedia of Polymer Science and Engineering, vol. 13, p. 453–463, 1988). It can be carried out as a precipitation polymerization or as a bulk polymerization. In some cases no free-radical initiator needs to be added. Similarly, the addition of crosslinkers is not necessary in some cases.

Dissolving monoethylenically unsaturated compounds in a solvent or solvent mixture and polymerizing them in the presence of suitable crosslinkers gives rise to crosslinked polymers of the gel type. Crosslinked polymers of the gel type can also be obtained by subsequently crosslinking dissolved polymers, for example with peroxides. For instance, water-soluble polymers of 1-vinylpyrrolidone and/or 1-vinylimidazoles of the formula I (i.e. homo- and copolymers each preparable by solely polymerizing at least one monomer of group (a)) can be converted into water-insoluble crosslinked polymers by subsequent crosslinking with, for example, peroxides or hydroperoxides or by the action of high-energy rays, for example UV, $\gamma$ or electron beam rays.

It may be of advantage in some instances to carry out the polymerization in the presence of polymerization regulators. Preference is given to polymerization regulators which contain sulfur in bonded form. Compounds of this type include for example sodium disulfite, sodium dithionite, diethanol sulfide, ethylthioethanol, thiodiglycol, di-n-hexyl disulfide, di-n-butyl sulfide, 2-mercaptoethanol, 1,3-mercaptopropanol, ethyl thioglycolate, mercaptoacetic acid and thioglycerol.

The water-insoluble, crosslinked polymers formally containing polymerized units of 4-vinylpyridine N-oxide are prepared by crosslinking copolymerization of 4-vinylpyridine and subsequent N-oxidation of the pyridine ring with, for example, peracetic acid generated in situ.

The water-insoluble crosslinked polymers are isolated in a conventional manner and, if necessary, ground to particles which in the dry state (moisture content up to not more than 2% by weight) have up to at least 90% by weight a particle size from 0.1 to 500 $\mu$m, preferably from 0.1 to 250 $\mu$m, especially from 0.1 to 50 $\mu$m.

The particle size is measured on dried polymers by vibratory sieve analysis. The range from 0.1 to 50 $\mu$m is covered by additionally employing the method of laser light scattering (Master Sizer, Malvern Instruments GmbH) on particles dispersed in air or in cyclohexane (not a swelling agent).

The reduction in particle size can be effected not only by dry grinding but of course also by wet grinding. The crosslinked products, which frequently have an irregular shape, can, if desired, be separated into various size classes by various methods of classification (sieving, sifting, hydroclassification). The water-insoluble crosslinked polymers are used according to the present invention in a finely divided form, at least 90% by weight of the polymers having a particle size from 0.1 to 500 $\mu$m, as detergent additives for inhibiting the transfer of dye during the wash. The detergents can be pulverulent or else liquid. The composition of detergent formulations can vary greatly. Detergent formulations usually contain from 2 to 50% by weight of surfactants and optionally builders. This applies both to liquid and pulverulent detergents. Detergent formulations customary in Europe, in the U.S. and in Japan are depicted for example in table form in Chemical and Engn. News 67 (1989) 35. Further information about the composition of detergents can be found in Ullmann's Encyklopädie der technischen Chemie, Verlag Chemie, Weinheim 1983, 4th Edition, pages 63–160. Detergents may optionally also contain a bleaching agent, for example sodium perborate, which if used can be present in the detergent formulation in amounts of up to 30% by weight. Detergents may optionally contain further customary additives, for example complexing agents, opacifiers, optical brighteners, enzymes, perfume oils, other color transfer inhibitors, grayness inhibitors and/or bleach activators. They contain the water-insoluble, crosslinked polymers to be used according to the present invention in amounts from 0.1 to 10% by weight.

The crosslinked polymers usable according to the present invention can also be used in combination, in any desired ratio, with uncrosslinked water-soluble polymers suitable for inhibiting dye transfer. The polymers to be used according to the present invention are eliminable from the effluent to at least 90%, preferably >95%. In the Examples, the percentages are by weight.

EXAMPLES

Preparation of Water-Insoluble Crosslinked Polymers

Example 1

In a stirred apparatus equipped with a reflux condenser, a mixture of 115 g of 1-vinylpyrrolidone, 2.3 g of N,N'-divinylethyleneurea, 1375 g of water and 1.0 g of sodium hydroxide solution (5% strength) was heated with stirring under nitrogen to 75° C. 25 mg of sodium disulfite were added, and stirring was continued at 75° C. for 5 hours. The precipitation polymer obtained was filtered off with suction, thoroughly washed with water and dried at 60° C. in a through circulation cabinet. The white, pulverulent product was obtained in a yield of 95%.

Example 2 a) In a stirred vessel, a solution of 30 g of 1-vinylpyrrolidone, 0.6 g of N,N'-divinylethyleneurea, 300 g of water and 0.4 g of sodium hydroxide solution (5% strength) was heated to 75° C. 10 mg of sodium dithionite were added, and the reaction mixture was stirred at 75° C. for 1 hour. To the resulting suspension was added a solution of 270 g of 1-vinylimidazole, 8.0 g of N,N'-divinylethyleneurea and 1200 g of water over 4 hours. This was followed by 2 hours of postpolymerization at 75° C. The work-up was carried out as described in Example 1. The slightly yellow, finely granular product was obtained in a yield of 93%.

b) In a stirred vessel, a solution of 30 g of 1-vinylpyrrolidone, 0.6 g of N,N'-divinylethyleneurea, 300 g of water and 0.4 g of sodium hydroxide solution (5% strength) was heated to 75° C. under nitrogen. 110 mg of sodium dithionite were added, and the reaction mixture was stirred at 75° C. for 30 minutes. To the resulting suspension was added a stirred mixture of 270 g of 4-vinylpyridine (freshly distilled), 8.1 g of N,N'-divinylethyleneurea and 1,200 g of water over 4 hours. This was followed by 2 hours of postpolymerization at 75° C. The work-up was carried out as described in Example 1. A pulverulent product was obtained in a yield of 98%.

20 g of the polymer thus prepared were suspended in 400 g of acetic acid. The suspension was admixed with 25 g of hydrogen peroxide (30% strength), heated to 84° C. and stirred at that temperature for 7 hours. The polymer was filtered off, repeatedly washed with water and dilute sodium hydroxide solution and dried at 60° C. in a through circulation cabinet. The yield of slightly yellow powder was 95%.

Example 3

Example 2 was repeated with a feed mixture of 90 g of 1-vinylimidazole, 2.3 g of N,N'-divinylethyleneurea and 500 g of water. The yield of pulverulent product was 92%.

Example 4

Example 2 was repeated with a feed mixture of 30 g of 1-vinylimidazole, 30 g of 2-methyl-1-vinylimidazole, 1.6 g of N,N'-divinylethyleneurea and 300 g of water. The yield of pulverulent product was 96%.

Example 5

72 g of 1-vinylimidazole were dissolved in 600 g of water together with 3.6 g of N,N'-divinylethyleneurea and 1.3 g of azobisisobutyronitrile and heated at 80° C. for 4 hours. The polymer obtained, which was of the gel type, was filtered off with suction, washed with water and dried at 60° C. under reduced pressure. The slightly yellow polymer was obtained in almost quantitative yield.

Example 6

In a stirred vessel, a vigorously stirred solution of 1100 g of water, 200 g of sodium sulfate and 1 g of polyvinylpyrrolidone of K 90 was admixed with a solution of 37.5 g of 1-vinylpyrrolidone, 112.5 g of 1-vinylimidazole, 8.5 g of N,N'-divinylethyleneurea, 200 g of ethyl acetate and 2.5 g of azobisisobutyronitrile over 10 minutes. The reaction mixture was heated under nitrogen to 72° C., stirred at that temperature for 2.5 hours, then admixed with 1.0 g of azobisisobutyronitrile and stirred at 72° C. for a further 2 hours. The product was filtered off with suction, washed and dried, affording light brown beads in a yield of 87%.

Example 7

Example 6 was repeated with a feed mixture of 75 g of 1-vinylpyrrolidone, 75 g of 1-vinylimidazole, 8.1 g of N,N'-divinylethyleneurea, 200 g of ethyl acetate and 2.5 g of azobisisobutyronitrile, affording pale brown beads in a yield of 85%.

Example 8 a) A stirred vessel equipped with a reflux condenser was charged with 400 g of ethyl acetate, 100 g of 1-vinylimidazole and 10 g of N,N'-divinylethyleneurea. 1.0 g of t-butyl perpivalate was added and the reaction mixture was heated to 72° C. and stirred at that temperature for 2 hours. The product was filtered off with suction, washed with 100 g of ethyl acetate and dried at 50° C. in a vacuum drying cabinet, affording a white, finely granular powder in a yield of 90%.

b) A stirred vessel equipped with a reflux condenser was charged with 900 g of cyclohexane, 50 g of 1-vinylimidazole, 50 g of 1-vinylpyrrolidone and 5.0 g of N,N'-divinylethyleneurea, and this initial charge was blanketed with nitrogen and heated to 80° C. in the presence of 1.0 g of 2,2'-azobis(2-methylbutyronitrile). The reaction mixture was stirred at 80° C. for 2 hours. After addition of 0.5 g of 2,2'-azobis(2-methylbutyronitrile), the mixture was stirred at 80° C. for a further 4 hours. To keep the reaction mixture stirrable, it was diluted with a total of 600 g of cyclohexane during the polymerization. The resulting product was filtered off with suction, thoroughly washed with cyclohexane and dried at 50° C. in a vacuum drying cabinet, affording a white, finely granular powder in a yield of 93%.

Example 9

In a 200 ml capacity flask equipped with a stirrer, reflux condenser, thermometer and apparatus for working under a protective gas, 800 g of cyclohexane and 8.4 g of a glycerol monooleate which had been reacted with 24 ethylene oxide units per molecule were heated to 40° C. As soon as this temperature was reached, a mixture of 100 g of N-vinylpyrrolidone, 100 g of N-vinylimidazole, 10 g of divinylethyleneurea, 0.5 g of 2,2'-azobis(amidinopropane) dihydrochloride and 140 g of water was added dropwise over 30 minutes. The reaction mixture was then stirred at 40° C. for sixteen hours. The temperature was subsequently raised to the boiling point of the mixture and the water was azeotropically distilled out of the reaction mixture via a water separator. The product was filtered off with suction, washed with 200 g of cyclohexane and dried at 50° C. in a vacuum drying cabinet for 8 hours, affording 186 g of a fine powder.

Use Examples

The color transfer inhibition is illustrated by washing trials in the presence of dye. Dye is either dissolved off cotton test dyeings during the wash or directly added to the wash liquor in the form of a solution.

Table 1 contains the washing conditions. The composition of the detergent used is indicated in Table 2.

The reflectance of the washed test fabrics was determined using an Elrepho 2000 from Data Color. Evaluation was at 600 nm in the case of Direct Blue 71 and at 440 nm in the case of Direct Orange 39.

TABLE 1

| | Washing conditions |
|---|---|
| Apparatus | Launder-o-meter |
| Cycles | 1 |
| Temperature | 60° C. |
| Duration | 30 min |
| Water hardness | 3 mmol of $Ca^{2+}$, $Mg^{2+}$ (4:1)/l |
| Test fabrics | 10 g of cotton, 5 g of polyester cotton, 5 g of polyester |
| Liquor ratio | 12.5:1 |
| Liquor quantity | 250 ml |
| Detergent concentration | 6 g/l |

Dye concentration: 0.001% of Direct Blue 71 or Direct Orange 39 as a 0.25% strength aqueous solution or Test dyeing 0.2 g of cotton fabric dyed with Direct Orange 39 or Direct Blue 71

TABLE 2

| | Composition of detergent (%) |
|---|---|
| Addition product of 7 mol of ethylene oxide with 1 mol of $C_{13}C_{15}$ oxo alcohol | 6.6 |
| Sodium $C_{10}C_{13}$-alkylbenzene-sulfonate, 50% strength | 18 |
| Zeolite A | 45 |
| Sodium citrate.5.5$H_2O$ | 12 |
| Soap | 1.8 |
| Copolymer of 70% by weight of acrylic acid and 30% by weight of maleic acid, molecular weight 70000 | 5.0 |
| Sodium carbonate | 7 |
| Magnesium silicate | 0.8 |
| Carboxymethylcellulose | 0.8 |
| Remainder $H_2O$ | to 100 |

The water-insoluble crosslinked polymers prepared as described in Examples 1 to 9 were separated for the polymers 1 to 15 into the particle size classes indicated in Table 3, at least 90% by weight of the polymers having a particle size within the stated range. The polymers 1 to 15 were tested as color transfer inhibitors in the detergent formulation described in Table 2, the polymers having the particle size indicated in Table 3.

TABLE 3

| | Prepared according to Example | Particle size of polymers [μm] |
|---|---|---|
| Polymer 1 | 1 | 250–500 |
| Polymer 2 | 1 | 0.1–50 |
| Polymer 3 | 2a | 0.1–50 |
| Polymer 4 | 3 | 50–100 |
| Polymer 5 | 2a | 500–750 |
| Polymer 6 | 6 | 50–100 |
| Polymer 7 | 7 | 50–100 |
| Polymer 8 | 8 | 50–100 |
| Polymer 9 | 5 | 50–100 |
| Polymer 10 | 4 | 100–250 |
| Polymer 11 | 9 | 50–100 |
| Polymer 12 | 2a | 0.1–20 |
| Polymer 13 | 2b | 0.1–20 |
| Polymer 14 | 8b | 0.1–20 |
| Polymer 15 | 9 | 0.1–20 |

TABLE 4

| | Color transfer inhibition | | |
|---|---|---|---|
| | Test dyeing Test fabric: | Direct Blue 71 Cotton Reflectance (%) | Direct Blue 71 Polyester-cotton Reflectance (%) |
| | Test fabric prior to wash: | 84.3 | 82.8 |
| | Test fabric after wash: | | |
| Ex. | Detergent without polymer | 49.4 | 59.7 |
| 10 | 0.5% Polymer 1 | 50.8 | 62.3 |
| 11 | 1.0% Polymer 1 | 51.7 | 62.2 |
| 12 | 2.0% Polymer 1 | 54.1 | 63.9 |
| 13 | 3.0% Polymer 1 | 57.1 | 66.0 |
| 14 | 0.5% Polymer 2 | 54.4 | 63.1 |
| 15 | 1.0% Polymer 2 | 57.4 | 65.0 |
| 16 | 2.0% Polymer 2 | 61.5 | 69.5 |
| 17 | 3.0% Polymer 2 | 63.9 | 71.4 |

The results of Table 4 show that the particle size has a decisive influence on color transfer inhibition. Polymer 2 is more effective than Polymer 1.

TABLE 5

| Example | Dye: Test fabric: cotton Detergent with 3% of polymer: | Direct Blue 71 Reflectance (%) | Direct Orange 39 Reflectance (%) |
|---|---|---|---|
| | Color transfer inhibition | | |
| 18 | Polymer 1 | 41.7 | 43.9 |
| 19 | Polymer 2 | 46.8 | 47.4 |
| 20 | Polymer 3 | 53.8 | 51.9 |
| 21 | Polymer 4 | 59.1 | 53.3 |
| 22 | Polymer 5 | 45.2 | 45.9 |
| 23 | Polymer 6 | 54.3 | 51.6 |
| 24 | Polymer 7 | 55.8 | 52.7 |
| 25 | Polymer 8 | 61.3 | 51.7 |
| 26 | Polymer 9 | 56.7 | 52.0 |
| 27 | Polymer 10 | 46 | 45.9 |
| 28 | Polymer 11 | 60.5 | 51.6 |
| | Test fabric prior to wash | 82.5 | 82.5 |
| | Test fabric after wash: detergent without polymer | 38.3 | 43.2 |

The wash results of Table 5 show that color transfer is distinctly suppressed by 3% of polymer. Polymers having a very small particle size are particularly suitable.

TABLE 6

| Example | Test fabric: cotton Test dye: Direct Orange 39 Detergent with 3% of polymer: | Reflectance (%) |
|---|---|---|
| | Color transfer inhibition | |
| 29 | Polymer 1 | 75.6 |
| 30 | Polymer 2 | 76.4 |
| 31 | Polymer 3 | 76.4 |
| 32 | Polymer 4 | 77.5 |
| 33 | Polymer 5 | 75.5 |
| 34 | Polymer 6 | 76.4 |
| 35 | Polymer 7 | 78.2 |
| 36 | Polymer 8 | 76.4 |

TABLE 6-continued

| Example | Test fabric: cotton Test dye: Direct Orange 39 Detergent with 3% of polymer: | Reflectance (%) |
|---|---|---|
| | Color transfer inhibition | |
| 37 | Polymer 9 | 75.9 |
| 38 | Polymer 10 | 74.6 |
| 39 | Polymer 11 | 77.3 |
| | Test fabric prior to wash | 82.5 |
| Comparative Example | Test fabric after wash: detergent without polymer | 73.1 |
| 1 | Polyvinylimidazole, K value 30 | 73.3 |
| 2 | Polyvinylpyrrolidone, K value 30 | 72.9 |
| 3 | Polyvinylpyrrolidone, K value 17 | 73.0 |

The wash results of Table 6 show that color transfer is distinctly suppressed by 3% of polymer. As illustrated by Comparative Examples 1 to 3, the crosslinked polymers of Examples 29–39 of the present invention are superior to uncrosslinked water-soluble polyvinylpyrrolidone and polyvinylimidazole.

TABLE 7

| Example | Polymer | Direct Blue 1 Reflectance (%) | Direct Blue 218 Reflectance (%) | Direct Red 79 Reflectance (%) | Direct Red 224 Reflectance (%) | Direct Black 38 Reflectance (%) |
|---|---|---|---|---|---|---|
| Color transfer inhibition with detergent of Table 2 | | | | | | |
| Test fabric: | | cotton | | | | |
| Polymer content of detergent: | | 1% by weight | | | | |
| Dye concentrations (wash liquor): | | | | | | |
| C.I. Direct Blue 1 | | 0.00025% | | | | |
| C.I. Direct Blue 218 | | 0.001% | | | | |
| C.I. Direct Red 79 | | 0.000125% | | | | |
| C.I. Direct Red 224 | | 0.00025% | | | | |
| C.I. Direct Black 38 | | 0.00025% | | | | |
| Test fabric prior to wash: | | 84% reflectance | | | | |
| Test fabric after wash: | | | | | | |
| | none | 67.9 | 68.8 | 70.0 | 68.5 | 67.5 |
| 40 | 12 | 78.7 | 80.8 | 76.2 | 73.4 | 72.1 |
| 41 | 13 | 78.1 | 78.8 | 75.6 | 72.7 | 72.1 |
| 42 | 14 | 77.5 | 82.4 | 74.1 | 73.0 | 72.5 |
| 43 | 15 | 81.6 | 82.8 | 77.7 | 76.2 | 75.1 |
| Comp. Ex. 4 | PVI K 30 | 84.0 | 83.9 | 73.6 | 71.2 | 69.9 |
| Comp. Ex. 5 | PVP K 30 | 69.3 | 69.6 | 71.9 | 68.3 | 68.3 |
| Comp. Ex. 6 | PVP K 17 | 68.8 | 69.2 | 71.7 | 68.3 | 68.2 |

The abbreviations in Table 7 have the following meanings:

PVI K 30: poly-1-vinylimidazole, K value 30

PVI K 30: poly-1-vinylpyrrolidone, K value 30

PVI K 17: poly-1-vinylpyrrolidone, K value 17

The K values of the water-soluble polymers were determined in 1% strength aqueous solution (25° C., pH 7) by the method of H. Fikentecher (Cellulose-Chemie, 13 (1932) 58–54, 71–74)

The wash results of Table 7 demonstrate the excellent color-transfer-inhibiting properties of polymers 12 and 15 used. The effect of uncrosslinked water-soluble poly-1-vinylpyrrolidone and poly-1-vinylimidazole (Comparative Examples 4 to 6) is in some cases distinctly exceeded.

We claim:

1. A detergent formulation, comprising from 0.1 to 10% by weight, based on the detergent formulation, of water-insoluble crosslinked polymer containing either polymerized units of 1-vinylimidazoles or polymerized units of 1-vinylimidazoles and 1-vinylpyrrolidones, wherein the 1-vinylimidazoles have the formula

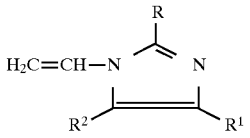

wherein R, $R^1$ and $R^2$ are identical or different and each is hydrogen, $C_1$–$C_4$-alkyl or phenyl, or of 4-vinylpyridine N-oxide; in finely divided form, at least 90% by weight of the polymer having a particle size from 0.1 to 500 $\mu$m; and a surfactant.

2. The detergent of claim 1, wherein at least 90% by weight of the polymer has a particle size from 0.1 to 250 $\mu$m.

3. The detergent of claim 1, wherein at least 90% by weight of the polymer has a particle size from 0.1 to 50 $\mu$m.

4. The detergent of claim 1, wherein the water-insoluble, crosslinked polymer is prepared by suspension polymerization, inverse suspension polymerization, precipitation polymerization or popcorn polymerization.

5. The detergent of claim 1, wherein the polymer contains polymerized units of N,N'-divinylethylene urea as a crosslinker.

6. The detergent of claim 1, wherein the polymer comprises N,N'-divinylethylene urea-crosslinked polymers of 1-vinylpyrrolidone, 1-vinylimidazole and/or 2-methyl-1-vinylimidazole.

7. A detergent formulation, comprising from 0.1 to 10% by weight, based on the detergent formulation, of water-insoluble crosslinked polymer containing polymerized units of 1-vinylpyrrolidone and/or 1-vinylimidazoles of the formula

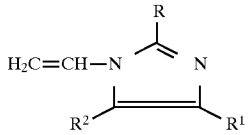

wherein R, $R^1$ and $R^2$ are identical or different and each is hydrogen, $C_1$–$C_4$-alkyl or phenyl, or of 4-vinylpyridine N-oxide; in finely divided form, at least 90% by weight of the polymer having a particle size from 0.1 to 500 $\mu$m; and a surfactant, wherein the polymer contains polymerized units of N,N'-divinylethylene urea as a crosslinker.

8. A detergent formulation, comprising from 0.1 to 10% by weight, based on the detergent formulation, of water-insoluble crosslinked polymer containing polymerized units of 1-vinylpyrrolidone and/or 1-vinylimidazoles of the formula

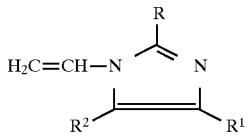

wherein R, $R^1$ and $R^2$ are identical or different and each is hydrogen, $C_1$–$C_4$-alkyl or phenyl, or of 4-vinylpyridine N-oxide; in finely divided form, at least 90% by weight of the polymer having a particle size from 0.1 to 500 $\mu$m; and a surfactant, wherein the polymer comprises N,N'-divinylethylene urea-crosslinked polymers of 1-vinylpyrrolidone, 1-vinylimidazole and/or 2-methyl-1-vinylimidazole.

* * * * *